United States Patent [19]

Saligny

[11] 4,288,832

[45] Sep. 8, 1981

[54] TWO-SECTION PROTECTION MODULE FOR CONNECTING BLOCKS

[75] Inventor: Yves Saligny, Cluses, France

[73] Assignee: Etablissement Carpano & Pons, France

[21] Appl. No.: 38,848

[22] Filed: May 14, 1979

[30] Foreign Application Priority Data

Jun. 9, 1978 [FR] France ..... 78 18477

[51] Int. Cl.[3] ..... H01H 39/00

[52] U.S. Cl. ..... 361/119; 361/124; 337/28; 337/32

[58] Field of Search ..... 361/104, 117, 127, 119, 361/120, 361, 337; 337/28, 29, 31, 32, 33, 34, 15, 18; 339/198 P, 198 R, 198 H

[56] References Cited

U.S. PATENT DOCUMENTS

| | | | |
|---|---|---|---|
| 3,255,330 | 6/1966 | MacKenzie et al. | 361/124 X |
| 3,825,867 | 7/1974 | Georgopulos | 361/124 |
| 4,057,843 | 11/1977 | Saligny | 361/124 X |
| 4,146,755 | 3/1979 | Causse | 361/119 X |
| 4,149,211 | 4/1979 | DeHoff | 337/34 X |

*Primary Examiner*—J. D. Miller
*Assistant Examiner*—L. C. Schroeder
*Attorney, Agent, or Firm*—Robert E. Burns; Emmanuel J. Lobato; Bruce L. Adams

[57] ABSTRACT

A protection module for connecting blocks is intended notably for at least one line wire of a telephone system and comprises a case having a ground terminal, an input terminal and an output terminal for each line wire, and a first lightning arrester having a first terminal connected to the ground terminal and a second terminal clamped resiliently between two extensions of the line terminals, respectively. Another lightening arrester has a first terminal connected to the ground terminal and a second terminal clamped resiliently between two extensions of the other pair of line wire terminals. An orifice registering with a third pair of terminals parallel to the other pair of line wire terminals is adapted to guide a detachable element which comprises an insulating portion adapted to be fitted between the terminals of the third pair of the lightning arresters and each extension of the pair of output terminals.

13 Claims, 12 Drawing Figures

TWO-SECTION PROTECTION MODULE FOR CONNECTING BLOCKS

FIELD OF THE INVENTION

This invention relates to protection modules for connecting blocks or like units, notably for use in telephone systems. These modules may be used for protecting a single wire of a line or several line wires. In most instances they are adapted to protect the two wires of a same line. They comprise a case consisting at least partially of insulating material and having fitted at a first end two conducting terminals for each line wire, and at least one ground conducting terminal. These terminals are adapted to be plugged in in a same direction and to cooperate with corresponding conducting terminals of the connecting unit or block. Disposed in the case is a protection device for each line wire, which is connected via a first terminal to the ground terminal of the module and via another terminal to two conducting extensions provided on the two conducting terminals corresponding to said line wire, respectively.

DESCRIPTION OF THE PRIOR ART

In protection modules of this type, such as disclosed in the French Pat. No. 2,309,061, it is not possible to disconnect a line while maintaining the protection of this line by means of the various protection devices, generally earth or lightning arresters, contained in the corresponding module. In fact, for disconnecting a line it is necessary to remove the corresponding module. Neither can the arresters constituting the protection devices be tested without disassembling these devices and therefore the module containing them. Similarly, when it is desired to have for certain lines a reinforced protection consisting for example for each line wire of a fuse, in addition to the arrester containing module must be removed and replaced integrally by another more complicated module containing an arrester and a fuse.

Obviously, other protection modules of this character are known, notably through the French Pat. No. 2.341.974, which are so designed that the modules can be partially disconnected for cutting off the corresponding line, but no means are provided for testing the protection devices contained in the module. Likewise, when it is desired to have a reinforced protection for certain lines, it is necessary to remove temporarily the module containing these protection devices and to replace them with another module containing the reinforced protection means. Now, this is an expensive solution and in addition the telephone line must be cut off temporarily.

SUMMARY OF THE INVENTION

It is the essential object of the present invention to provide a protection module having a simple structure and capable of protecting the corresponding line or lines, even when it is necessary to disconnect these lines or to reinforce their protection means. Moreover, these reinforcements of the protection means, the testing thereof and possibly the fitting of means for signalling the faulty protection devices, can be obtained without removing the module from the connecting block to which it is plugged in. Thus, except when it is desired to eliminate completely the protection of a line, and consequently the corresponding module proper, this module remains constantly in position, so that the risk of damaging same is reduced considerably and the cut-off time periods of the corresponding lines are also minimized.

The protection module according to this invention comprises a case consisting at least partially of insulating material and having at a first end a pair of conducting terminals for each line wire and a ground conducting terminal; these terminals are adapted to be plugged in in a same direction and to cooperate with corresponding conducting terminals of the connecting block. A protection device for each line wire is incorporated in the case and connected through a first terminal to the ground terminal of the case and through a second terminal to a pair of conducting extensions provided on the two conducting terminals corresponding to said line wire, respectively. Without departing from the basic principles of this invention, each conducting extension is an integral part of the relevant conducting terminal; thus, it may consist for example of a resilient blade or a spring-loaded push member. The second terminal of each protection device is thus held resiliently between two corresponding conducting extensions and registers with at least one orifice formed at the second end opposite the first end of the case. This orifice is so shaped and dimensioned that it can receive one portion of a detachable element adapted to cooperate with the second terminal of the protection device and with at least one of the two corresponding conducting extensions.

In certain applications and generally this module will be used without the above-mentioned detachable element while constantly preserving the possibility of temporarily introducing or not this detachable element into the orifice provided for this purpose.

Thus, this orifice acts as a guide means for the detachable element of which a first portion will then cooperate with the second terminal of the protection device and also with at least two corresponding protection extensions. A second portion of the detachable element is disposed outside the protection module and acts as a gripping means.

According to a specific form of embodiment, the whole of the first portion or section of the detachable element is insulating, and adapted to be fitted between the second terminal of the protection device and one of the two conducting extensions cooperating with this second terminal. Means are provided for keeping at least this second terminal in position during the insertion of the first portion of the detachable element, in order to prevent the elastic deformation of the other conducting extension cooperating with the second terminal.

In a second form of embodiment, the first section of the detachable element is made mainly of insulating material and adapted to be fitted, for one portion between the second terminal of the protection device and one of the two conducting extensions cooperating with this second terminal, and for the other portion between the second terminal of the protection device and the other conducting extension cooperating with this second terminal. The first insulating section of the detachable element contains a central conducting portion adapted to be connected for one part to the second terminal of the protection device and for the other part to an external electric circuit, so that the operation of the protection device can be checked at any time. In this modified form of embodiment, the means for keeping the second terminal in position when inserting the first section of the detachable element can be dispensed with; however, their permanent presence in the module is not attended by any inconvenience.

In a third possible form of embodiment the first section of the detachable element is still mostly made of insulating material; as in the first form of embodiment mentioned hereinabove, it is adapted to be fitted between the second terminal of the module protection device and one of the pair of conducting extensions cooperating with this second terminal. Moreover, the second section of the detachable element supports or holds an additional protection device coupled across two conducting elements bearing against, or supported by, the two opposite sides, respectively, of the first section of the detachable element. The first conducting element is adapted to engage one of the conducting elements registering therewith. The second conducting element is adapted to engage the second terminal, registering therewith, of the protection device, and/or the other conducting extension.

A fourth form of embodiment somewhat similar to the preceding one further comprises at least one additional conducting signal terminals adapted to be plugged in in the same direction as the ground terminal and the two terminals corresponding to each line wire, said signal terminal being disposed on one side of said line wire terminals. The first insulating section of the detachable element further comprises a pair of additional conducting elements disposed on either side of the other conducting elements, respectively, on one side of the other conducting elements, each on one of the opposed sides of said first section; these additional conducting elements are electrically interconnected via a front contact incorporated in the second section of the detachable element. This front contact is adapted to be closed in case the additional protection device were damaged. One of these additional conducting elements is kept in contact with a conducting extension of the ground terminal; the other additional conducting element is kept in contact with a conducting extension of the signal terminal.

DESCRIPTION OF THE PREFERRED EMBODIMENTS

Figure 1:
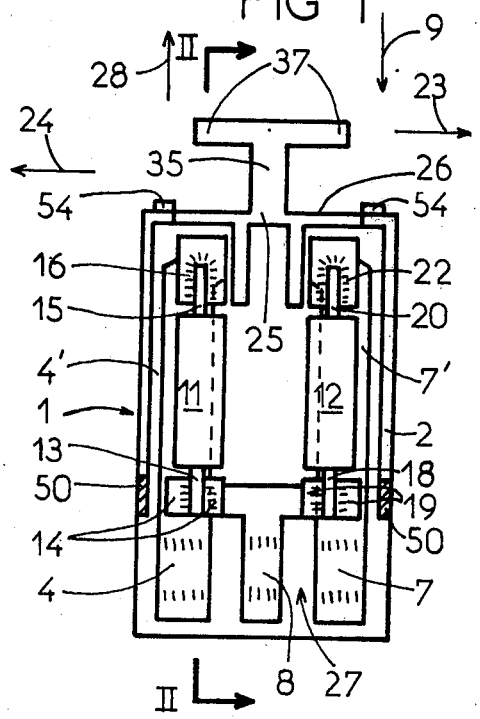
FIG. 1 illustrates a first form of embodiment of the two-section protection module for connecting blocks, according to this invention, as seen in the direction of the arrows I—I of FIG. 2.

As shown in FIG. 1 to 6 of the drawings, the protection module comprises an insulating case 1 consisting of two portions, sections or half-cases 2 and 3 having substantially the same general configuration and disposed in face to face relationship when the insulating case 1 is closed. In this example, the case 1 is adapted to enclose the protection means necessary for two line wires. To this end, the case portion 2 encloses an "input" conducting terminal 4 and an "output" conducting terminal 7, and an "output" conducting terminal 5 and an "input" conducting terminal 6 registering respectively with the former and enclosed in the other case section 3. Each input terminal is somewhat spaced from the corresponding output terminal. On the case portion 2, between terminals 4 and 7, a "ground" conducting terminal 8 is provided. These terminals, 4, 5, 6, 7 and 8 which, in this example, have curved end portions, are adapted to be plugged in in the same direction shown by the arrow 9 in FIG. 2, and to cooperate with corresponding conducting terminals of a connecting block which, in this example, is designed for connecting a cable end or head. In this example, the conducting terminals 4 and 6 are referred to as "input" terminals because they are adapted to be plugged on "input" terminals of the connecting block to which the line wires issuing from the cable head are connected. The connecting terminals 5 and 7 are referred to as "output" terminals because they are adapted to be plugged on "output" terminals of the connecting block, to which the corresponding wires leading to the automatic switching device are connected. The "ground" terminal 8 is adapted to be plugged on a corresponding or matching ground terminal provided on the connecting block.

The case 1 also contains two protection devices consisting for example of a pair of lightning arresters 11 and 12, respectively, disposed longitudinally in the case 1. The first arrester 11 comprises a first terminal consisting in this example of a conducting rod 13 retained in a first resilient clip 14 connected to the ground terminal 8. It also comprises a second terminal consisting in the same example of a conducting rod 15 retained by clamping action between the corresponding ends, 16 and 17, bent at an angle of about 180°, of a pair of conducting extensions 4' and 5' of the input and output conducting terminals 4 and 5, respectively. Similarly, the other arrester 12 comprises a first terminal consisting of a conducting rod 18 retained in a second resilient clip 19 also connected to the ground terminal 8. This arrester 12 further comprises a second terminal consisting of a conducting rod 20 retained by resilient clamping action between the bent ends 21 and 22 respectively of a pair of conducting extensions 6' and 7' of the input and output conducting terminals 6 and 7, respectively. The bent ends 16, 17 and 21, 22 are slightly stamped in order to prevent the subsequent movement, in the direction of the arrows 23, 24 and 28, of conducting rods 15 and 20. These conducting rods 15 and 20 register with an orifice 25 formed at the other end of case 1 which is opposite the first end 27 comprising the plug-in terminals 4, 5, 6, 7 and 8.

Figure 2:
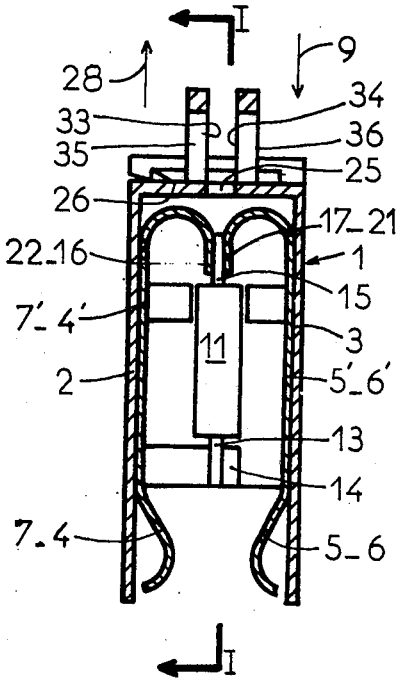
FIG. 2 is a section taken along the line II—II of FIG. 1.
Figure 3:
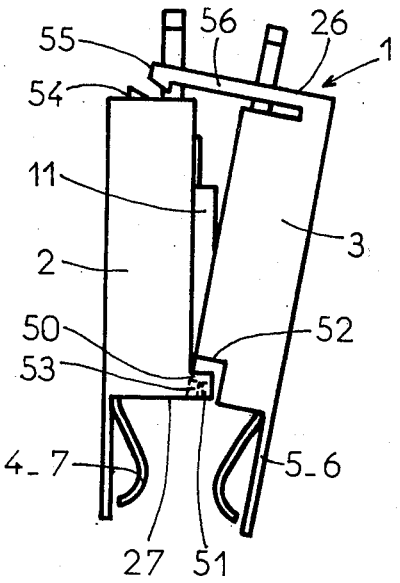
FIG. 3 is a view similar to FIG. 2 but in elevation, showing the same form of embodiment of the module during the assembling thereof.

The orifice 25 has such shape and dimensions that it constitutes a guide means for a detachable element 31 (see FIGS. 4 and 6), in fact for a first portion 32 thereof, which in this example is completely insulating. The orifice 25 has a rectangular cross-sectional contour and is directed along the longitudinal axis of case 1; this cross-sectional contour is provided on the one hand on the first section 2 and on the other hand on the second section 3. It comprises extensions in the form of a pair of flat faces 33 and 34 registering with each other and formed on two gripping elements 35 and 36, respectively, projecting from the other end 26 of case 1, each gripping element being supported by one of the case sections 2, 3. The conducting rods 15 and 20 are directed parallel to the longitudinal axis of orifice 25, along the median plane of this orifice 25, which corresponds to the plane of section I—I (FIG. 2). Each gripping element 35, 36 is T-shaped at 37, as shown in FIG. 1, to facilitate the gripping thereof.

Figure 6:
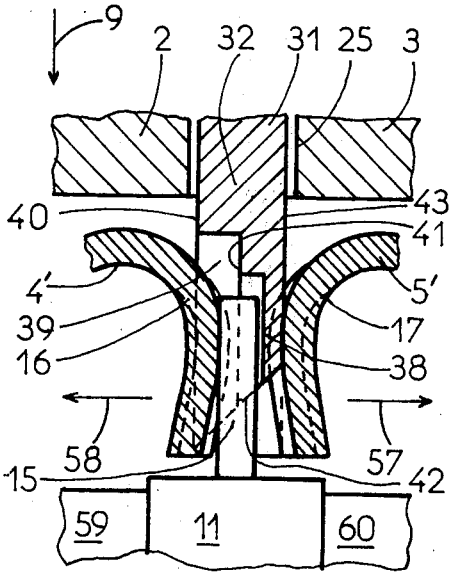
FIG. 6 illustrates on a larger scale a detail of the device shown in FIG. 5.

The first portion 32 of the detachable element 31 is so shaped that when it is engaged into the guide orifice 25 it can cooperate with the conducting rods 15, 20 of arresters 11 and 12, and also with the bent ends 17 and 22 of the relevant conducting extensions 5' and 7' of the plug-in output terminals 5 and 7. To this end, this first portion 32 is formed, for one part, as illustrated in FIG. 6. The free end of the first portion 32 comprises a recess 38 formed along the longitudinal axis of the end portion of the conducting rod 15, and so shaped and dimensioned as to receive said end portion. This recess 38 opens laterally into another cavity 39 formed on one side 40 of the first portion 32, this side registering with the bent end 16 of the conducting extension 4' of the plug-in input terminal 4. This cavity 39 extends at least substantially to the longitudinal center line or plane of rod 15 and terminates with a face 41. Its width is sufficient to permit the free passage of the bent end 16. On the other hand, the same free end of the first portion 32 of the detachable element 31 comprises a bevel surface corresponding to the inclined face shown at 42 in this example. This inclined face 42 is directed towards the other side 43 opposite the first one 40 of the first portion 32. It is adapted to cooperate with the bent end 17 of the conducting extension 5' of the plug-in output terminal 5.

Figure 4:
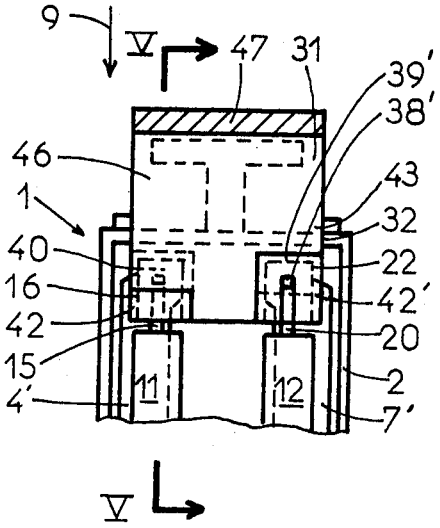
FIG. 4 is a section taken along the line IV—IV of FIG. 5, showing a modified form of embodiment of the detachable element of the device.
Figure 5:
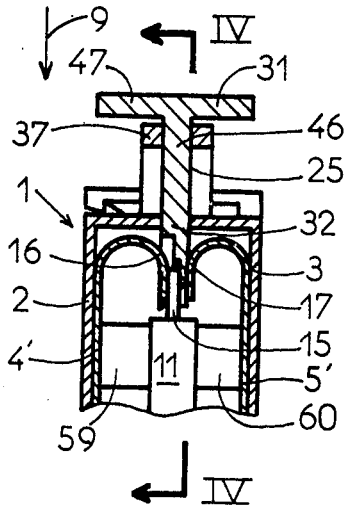
FIG. 5 is a section taken along the line V—V of FIG. 4, showing the same form of embodiment of the invention.

As illustrated notably in FIG. 4, the free end of the first portion 32 further comprises a cavity 38' adapted to receive the conducting rod 20 of arrester 12. This cavity 38' opens into a recess 39' formed in front of the bent end 21 of the conducting extension 6' of input terminal 6. On the other hand, an inclined face 42' is provided for cooperating with the bent end 22 of the conducting extension 7' of output terminal 7. The portions 38' and 39' are inverted with respect to the similar portions 38 and 39, and are formed on the face 43 of the first portion 32. Similarly, the inclined plane 42' is inverted in relation to the similar inclined plane 42, and formed on the face 40 of the first portion 32.

The detachable element 31 further comprises a second portion 46 located outside the case 1 of the protection module. It comprises a transverse portion 47 adapted to act as a gripping element, which covers and conceals the transverse portion 37 of the T-shaped gripping members 33 and 34. In this form of embodiment, the complete detachable element 31 is made of insulating material, for example by molding a suitable plastics material having a color other than that of the molded elements 2, 3 of the module case 1 to which it is to be fitted. Thus, for example, the case 1 may be made of a relatively dark plastic material, and the detachable element, namely its second visible portion 47, may be white.

On the other hand, connecting means are provided on each case section 2, 3 to permit the easy assembling thereof. Thus, at its end 27 (see FIGS. 1 and 3) the case section 2 comprises on each side an ear 50 provided with a lateral catch 51; similarly, the other case section 3 comprises on either side a cavity 52 having dimensions sufficient to accomodate the ear 50 provided with a lateral catch 53. On the other hand, at its end 26 the case section 2 comprises on either side a catch 54 adapted to cooperate by snap action with a pawl 55 formed at the end of an elastic arm 56 formed integrally with the other case section 3.

With this arrangement, the module can be assembled very simply after positioning the pair of lightning arresters 11 and 12 in the first case portion, half or section 2, by causing the catches 51 thereof (FIG. 3) to fit behind the lateral catches 53 of case section 3, whereafter the two case portions, halves or sections are approached until the pawls 55 of one section is snappily engaged beyond catches 54 of the other section. Thus, the protection module is ready for use: it is only necessary to plug it on the corresponding terminals of the connecting block (not shown).

When plugged in, the protection module according to this invention provides a permanent protection of the two line wires of a subscriber. The electrical continuity is provided between each input terminal 4, 6 and the corresponding output terminal 5, 7 via a conducting rod 15 or 20. Moreover, each input terminal and the corresponding output terminal are connected to the ground terminal 8 via a lightning arrester 11 or 12.

When it is desired to cut off the line protected by this module, it is only necessary to introduce in the direction of the arrow 9 the insulating movable element 31 into the guide orifice 25. In the example illustrated in FIG. 6, when the inclined face 42 engages the bent end 17 of the conducting extension 5', the latter is pushed in the direction of the arrow 57 and then engages the face 43 of the first portion 32 of the movable element 31. The electrical continuity is thus broken between extensions 4' and 5'. The same applies between the extensions 6' and 7'. At the same time, the conducting rod 15 is partially received in recess 38, the adjacent cavity 39 enabling the bent end 16 to remain in contact with said conducting rod 15. For a similar reason, the recess 38' and cavity 39' enable the bent end 21 to remain in contact with the conducting rod 20.

Holding means are provided for keeping each conducting rod 15, 20 in position during the insertion of the first portion 32 of the detachable element 31, in order to prevent an unduly pronounced elastic distortion of the bent ends 16 and 21, respectively. They may consist for example of intermediate relief portions 59 and 60 (FIG. 6) formed integrally with the case 1 and acting as lateral bearing means to the arresters 11 and 12, respectively, at least in the direction shown by the arrows 58 and 57, respectively.

Figure 7:
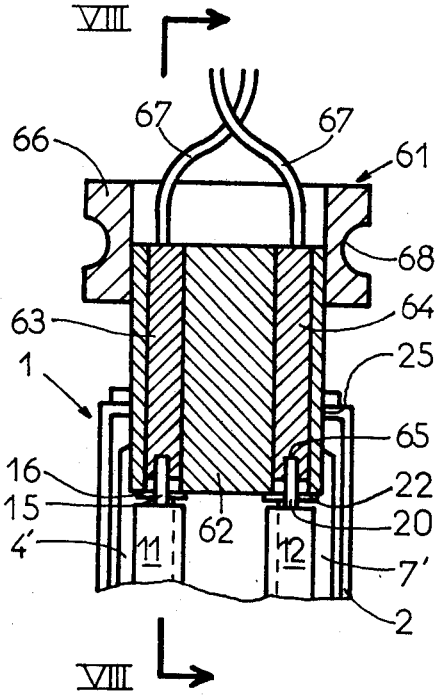
FIG. 7 is a section taken along the line VII—VII of FIG. 8, showing another modified form of embodiment of the detachable element according to this invention.
Figure 8:
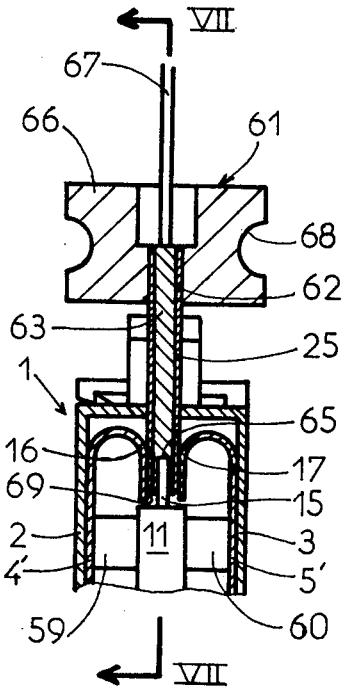
FIG. 8 is a section taken along the line VIII—VIII of FIG. 7, showing the same modified form of embodiment.

Thus, with this module, when the two line wires are effectively cut off, the input terminal of each line wire remains connected to the ground terminal 8 via an arrester 11, 12, and therefore the line is constantly and reliably protected. FIGS. 7 and 8 illustrate a modified form of embodiment wherein the detachable element 31 is replaced by a detachable element 61 constituting a connector permitting of testing the lightning arresters 11 and 12. This detachable element 61 comprises a first, mainly insulating portion 62 having external dimensions just sufficient to permit the sliding movement thereof in the guide orifice 25 of case 1. When this first portion 62, provided with a tapered inlet 69 to facilitate its introduction, is inserted into the guide orifice 25, it separates and insulates electrically each conducting rod 15, 20 from the bent ends 16 and 17, 21 and 22, respectively, between which each rod 15 and 20 is normally retained by an elastic clamping force. The first insulating portion 62 of the detachable element 61 further contains two central conducting portions 63 and 64 disposed for instance along the same axis as the rods 15 and 20, respectively, of arresters 11 and 12. Each central conducting portion comprises for example at one end an orifice 65 adapted to receive the corresponding conducting rod 15 or 20 which is thus connected to this central conducting portion by its end which will thus abut the bottom of said orifice 65. The other end of each central conducting portion 63, 64 also extends through the second, outer portion 66 of the detachable element 61; a wire 67 is connected to each of them. The second portion 66 comprises on its outer periphery a hollow groove or like configuration 68 adapted to facilitate the gripping of the detachable element 61. All the other component elements of the protection module are identical with those of the preceding form of embodiment described with reference to FIGS. 1 to 3 of the drawings.

Thus, fitting this detachable element 61 will permit, with the assistance of an external device to which each wire 67 is connected, of testing the proper operation of each arrester 11, 12 which is temporarily isolated from the corresponding input and output circuits. At the same time, the circuit of each line is cut off but this disconnection requires a very short time since, when the detachable element 61 is removed from the guide orifice 25, the continuity and protection of each line are restored instantaneously.

Figure 9:
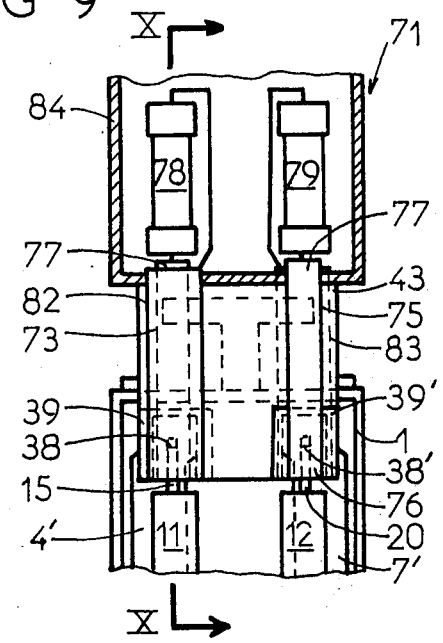
FIG. 9 is a section taken along the line IX—IX of FIG. 10, showing a third form of embodiment of the detachable element according to this invention.
Figure 10:
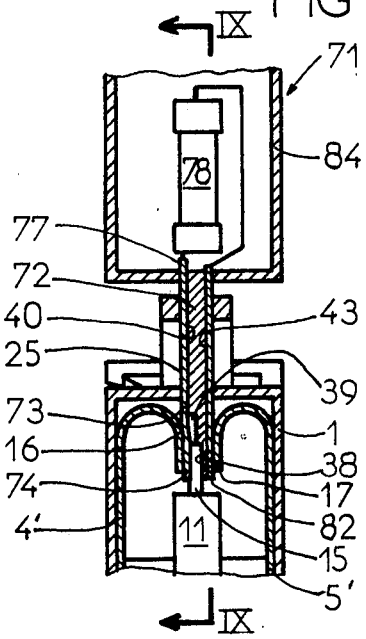
FIG. 10 is a section taken along the line X—X of FIG. 9, showing the same form of embodiment.

FIGS. 9 and 10 illustrate another form of embodiment of the invention wherein the detachable element 31 is replaced by a modified detachable element 71. This modified detachable element 71 constitutes in this case an additional module adapted to be plugged into the case 1 of the module described hereinabove with reference to FIGS. 1 to 3. The detachable element 71 comprises a first, mainly insulating portion 72 adapted to be inserted into the guide orifice 25. This first portion 72 comprises, as in the embodiment illustrated in FIGS. 4 to 6, a pair of recesses 38 and 38' adapted to receive the conducting rods 15 and 20, respectively, of arresters 11 and 12. It also comprises a pair of cavities 39 and 39' also described hereinabove. A conducting element 73, having for example a flat cross-section, is for one part pressed against the face 40 of the first portion 72 and, for the other part, has its first end 74 only supported by said face 40; in fact, this end 74 is somewhat clear from the cavity 39. Similarly, a conducting element 75 is for one part pressed against the face 43 of the first portion 72 and has for the other part its first end 76 only supported by said face 43; in fact, this end 76 registers with the corresponding cavity 39'. Each second end 77 of a conducting element 73, 75 is connected to a first terminal of a fuse 78, 79, respectively.

On the other hand, the face 43, at a point registering with and parallel to, the conducting element 73, carries another flat conducting element 82 having one portion connected to the second terminal of fuse 78. Similarly, the face 40, at a point registering with, and parallel to, the conducting element 75, carries another flat conducting element 83 having one portion connected to the second terminal of fuse 79. The fuses 78 and 79 are enclosed in a box 84 constituting the second portion of each detachable element 71.

When first portion 72 of the additional detachable element 71 is plugged into the orifice 25, the end 74 of the conducting element 73 is fitted between the conducting rod 15 of arrester 11 and the bent end 16 of input terminal 4 (FIG. 1), between which it provides the electrical connection, the prestress of the bent end 16 constantly urging the end 74 against the rod 15. On the other hand, the conducting element 82 is in contact with the bent end 17 of the corresponding output terminal 5 (FIG. 2). Similarly, the end 76 is fitted between the conducting rod 20 of arrester 12 and the bent end 21 of input terminal 6 (FIG. 2); besides, the conducting element 83 is in contact with the bent end 22 of output terminal 7 (FIG. 1).

Thus, when the detachable element 71 is plugged into the orifice 25, the input terminal 4 of the protection module remains constantly connected to the ground terminal 8 via the arrester 11, but at the same time the rod 15 of arrester 11 is insulated from the bent end 17 of output terminal 5, the fuse 78 being connected in series, at the same time, between the input terminal 4 and the corresponding output terminal 5. Similarly, the input terminal 6 remains constantly connected to the ground terminal 8 via the arrester 12, and the fuse 79 is at the same time connected in series between the input terminal 6 and the corresponding output terminal 7.

These fuses 78, 79 will thus provide an additional protection for the line wires to which the terminals 4 to 8 of the protection modules are to be connected. This advantageous result is obtained without having to disconnect the case 1, therefore without cutting off the corresponding line, were it for only a very short time.

It would not constitute a departure from the basic principles of this invention to shape the ends 74 and 75 with a view to accomodate the shape of the corresponding recesses 38, 38', and thus engage the conducting rods 15 and 20 without being engaged between these rods and the corresponding bent ends 16 and 21.

Figure 11:
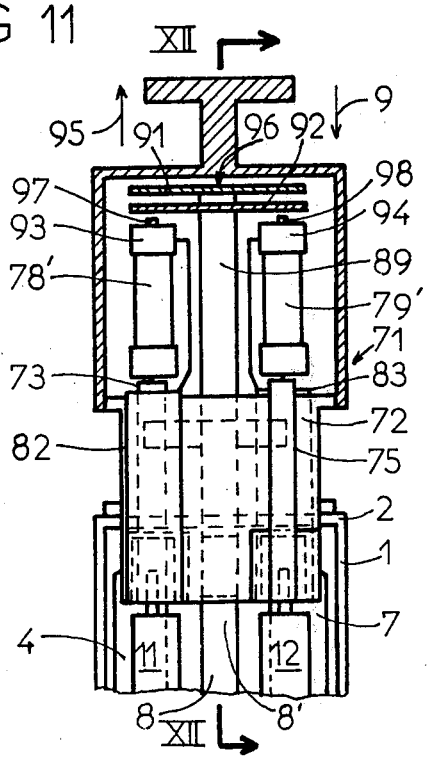
FIG. 11 is a section taken along the line XI—XI of FIG. 12, showing a fourth form of embodiment of the detachable element, according to this invention.
Figure 12:
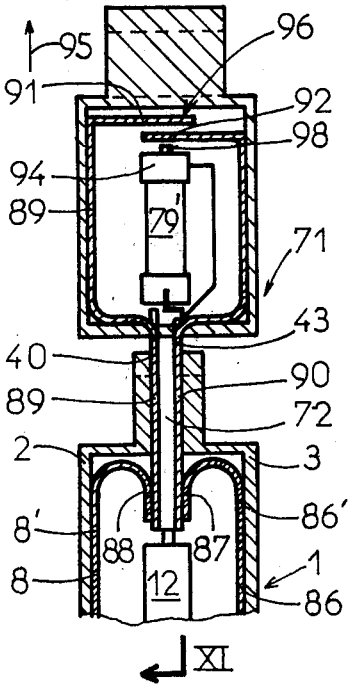
FIG. 12 is a section taken along the line XII—XII of FIG. 11, showing the same modified form of embodiment.

The modified embodiment illustrated in FIGS. 11 and 12 is partly identical with the modified structure shown in FIGS. 9 and 10 described hereinabove. Thus, the case 1 supports an additional signalling conducting terminal 86 adapted to be plugged in in the direction 9 like the other plug-in terminals 4 to 8. In this example, this signal terminal 86 is supported by the half-case or section 3 and extends between terminals 5 and 6, and registers with the ground terminal 8. The signal terminal 86 (FIG. 12) comprises a conducting extension 86' having its free end 87 bent to an angle of about 180°, which registers with the bent end 88 of a conducting extension 8' of said ground terminal 8.

The first insulating portion 72 of the detachable element 71 comprises two additional conducting elements 89 and 90. The first additional conducting element 89 is supported by the face 40 and extends between the other conducting elements 73 and 83 disposed on the same face; it further contacts the bent end 89 of conducting extension 8'. The other additional conducting element 90 is supported by the face 43 and extends between the other conducting elements 75 and 82, and contacts the bent end 87 of the conducting extension 86'. On the other hand, the additional conducting elements 89 and 90 are each connected to one of the contact studs 91 and 92, respectively, of a front contact 96. The latter is disposed in front of one of the terminals 93 and 94, respectively, of each fuse 78' and 79'. Each fuse 78' and 79' comprises a spring-loaded push member, designates by the reference numerals 97 and 98, respectively, which, when one of the corresponding fuses burns out, moves in the direction of the arrow 95 and closes the front contact 96. The electrical continuity is thus provided between the ground terminal 8 and the signal terminal 86; these terminals 8 and 86, when the module is plugged on the connecting block for which it is intended, are adapted to control the signal device provided for example on said block. All the other component elements are identical with those of the modified embodiment described hereinabove with reference to FIGS. 9 and 10 of the drawings. Finally, the device illustrated in FIGS. 11 and 12 operates like the one already disclosed with reference to FIGS. 9 and 10.

The protection module according to this invention can be utilized whenever it is desired to obtain a protection as permanent as possible for one or several lines, while permitting of carrying out certain testing operations on the module. It is particularly advantageous to use these modules in a connecting block for cable head.

What is claimed is:

1. A protection module for connecting blocks, notably of telephone systems, intended for at least one line wire, said device comprising a case made at least in part of insulating material and having first and second ends, a pair of first and second conducting terminals for each line wire and a ground conducting terminal at said first end of said case in position to be plugged in in the same direction and to cooperate with corresponding terminals of the connecting block, said first and second conducting terminals having conducting extensions extending toward said second end of said case and having resilient end portions biased toward one another, a protection device for each line wire disposed in said case and having at one end a first terminal electrically connected with said ground terminal and, at an opposite end, a second terminal gripped resiliently between said resilient end portions of said first and second conducting terminals in direct contact therewith, said case having in said second end an orifice opening to said second terminal of said protection device and said resilient end portions of said conducting terminals, and a detachable element of a size and shape for insertion through said orifice to an inner position for cooperation with said second terminal of said protection device and said resilient end portions of said conducting terminals, said detachable element being detachable from said module by withdrawing it from said orifice and replaceable by a different detachable element.

2. A protection module as claimed in claim 1, wherein said case has adjacent said orifice guide portions for guiding said detachable element into said orifice.

3. A protection module as claimed in claim 2, wherein said detachable element has a first portion insertable through said orifice and a second portion located outside said case and constituting gripping means.

4. A protection module as claimed in claim 3, wherein said first portion of said detachable element is made of insulating material and fits between said second terminal of said protection device and one of said two conducting extensions cooperating with said second terminal, means being provided for keeping said second terminal in position during the insertion of said first portion of said detachable element, so as to prevent elastic distorsion of the other of said conducting extensions cooperating with the second terminal.

5. A protection module as claimed in claim 4, wherein said means provided for holding said second terminal in position when inserting the first portion of said detachable element consists of at least one internal relief portion of said case, which acts as a lateral support to the corresponding protection device, at least on the side of the conducting extension which constantly engages the second terminal of said protection device.

6. A protection module as claimed in claim 3, wherein said first portion of said detachable element is made of insulating material and has one port insertable between said second terminal of said protection device and one of said two conducting extensions cooperating with said second terminal, and part insertable between the same second terminal of said protection device and the other of said conducting extensions cooperating with said second terminal, said first portion containing a central conducting section for electrical contact at one end to said second terminal of said protection device and for connection at the other end to an external electric circuit so as to permit the easy checking of the operation of the protection device.

7. A protection module as claimed in claim 3, wherein said detachable element has in said second portion thereof a second protection device and in which said first portion comprises an insulating part insertable between said second terminal of said first mentioned protection device and one of said two conducting extensions, a first conducting part for making electrical connection between said one conducting extension and said second protection device and a second conducting part for making electrical connection between the other of said two conducting extensions and said second protection device.

8. A protection device as claimed in claim 7, wherein a signal terminal is provided in said case opposite said ground terminal in position to be plugged in in the same direction as said ground terminal and said first and second conducting terminals, said ground terminal and said signal terminal being extended toward said second end of said case and having resilient end portions, and wherein said first portion of said detachable element has an insulating part insertable between said ground terminal extension and said signal terminal extension and two additional conducting elements engaging said ground terminal extension and said signal terminal extension respectively when said detachable element is inserted through said orifice into said case.

9. A protection device as claimed in claim 8, wherein said second protection device has signal actuating means which is actuated in the event of failure of said second protection device, and wherein contacts connected respectively with said additional conducting elements are closed by said actuating means in the event of actuation thereof.

10. A protection module as claimed in claim 1, wherein said second terminal of said protection device consists of a conducting rod of which an end portion extends to said orifice of said case in the median plane of said orifice, wherein the free end of the first portion of said detachable element comprises a recess extending in the axial direction of said conducting rod, and so shaped and dimensioned as to be capable of receiving said end portion, said recess opening laterally into a cavity formed on one side of said first portion of said detachable element, which registers with one of said conducting extensions cooperating with said conducting rod, said cavity extending from said recess at least substantially to the longitudinal axis of said rod, the free end of said first portion of said detachable element having a bevelled surface directed towards a second side, opposed to said one side, of said first portion, being adapted to cooperate with the other of said conducting extensions.

11. A protection module as claimed in claim 1, wherein said case comprises two parts which are separable from one another to provide access to said protection device and means for securing said parts of said case together.

12. A protection module as claimed in claim 1, wherein said resilient end portions of said conducting extensions of a pair of said conducting terminals are bent arcuately toward one another through 180°.

13. A protection module as claimed in claim 1, wherein two pairs of said conducting terminals are disposed in said case and are spaced laterally from one another, and wherein said ground terminal is disposed between said two pairs of conducting terminals.

* * * * *